United States Patent [19]

Euler et al.

[11] Patent Number: 4,658,884

[45] Date of Patent: Apr. 21, 1987

[54] MOLD FOR CONTINUOUS CASTING OF ROUNDS OR BILLETS

[75] Inventors: Horst Euler, Duisburg; Hans-Joachim Meyer, Krefeld; Fritz-Peter Pleschiutschnigg, Duisburg, all of Fed. Rep. of Germany

[73] Assignee: Mannesmann AG, Duesseldorf, Fed. Rep. of Germany

[21] Appl. No.: 709,499

[22] Filed: Mar. 8, 1985

[30] Foreign Application Priority Data

Mar. 28, 1984 [DE] Fed. Rep. of Germany ..... 3411359

[51] Int. Cl.[4] ..... B22D 11/124

[52] U.S. Cl. ..... 164/443; 164/348

[58] Field of Search ..... 164/443, 348, 418, 485

[56] References Cited

U.S. PATENT DOCUMENTS 3,667,534 6/1972 Kanokogi et al. ..... 164/443 X 4,285,388 8/1981 Sevastakis ..... 164/348 X 4,374,539 2/1983 Colombo ..... 164/443

FOREIGN PATENT DOCUMENTS 667322 6/1979 U.S.S.R. ..... 164/443

*Primary Examiner*—Kuang Y. Lin

*Attorney, Agent, or Firm*—Ralf H. Siegemund

[57] ABSTRACT

A tubular mold is included in a coolant container there being a tubular guide sheet arranged around the mold at a certain distance therefrom, the coolant flows through the gap between the mold and the guide sheet; as specific improvement the upper portion of the mold has grooves cut into the outside to be flown though by water offering therefore a relatively enlarged cooling surface as compared with the remainder of the configuration of the mold underneath, the guide sheet has a radially inward extension such that water is forced into and through the grooves; these grooves are provided in the area in which the liquid bath level is expected to occur in the mold.

7 Claims, 3 Drawing Figures

MOLD FOR CONTINUOUS CASTING OF ROUNDS OR BILLETS

BACKGROUND OF THE INVENTION

The present invention relates to a mold for continuous casting particularly for round or billet type ingots, particularly of steel, and including a tubular mold enveloped by facilities for cooling with feed and discharge for the cooling medium as well as an intermediate cooling guidance tube which together with the mold tube proper establishes an annular gap for guiding the cooling fluid such as water along the mold.

Molds of the type to which the invention pertains are for example used in continuous casting of steel as well as non-ferrous metals wherein in case of rounds the ingot has a diameter between 100 and 500 mm while in the case of billets the format runs from about 70 by 70 mm up to 200 by 200 mm. Austrian pat. No. 238,388 suggests mold for casting of this type and suggests particularly for economical and engineering reasons to provide the tubular mold with smooth surfaces on the inside as well as on the outside. Coolant flow is established through a coolant guiding tube having a wall thickness of about 4 mm. The tubular guiding sheet envelops the mold and establishes an annular gap vis-a-vis the mold on the outside thereof and having a gap width of about 6 to 8 mm. The tubular mold itself has usually a wall thickness of about 12 mm.

Molds constructed in the aforementioned manner usually have use-life of approximately not more than 150 charges particularly in the case of casting of steel after which the mold tube is to be exchanged for the new one.

Aside from the foregoing the known molds for billet or round castings usually produce an ingot which quite frequently deviates at the exit of the mold from the theoretically assumed and cast contour and exhibits a romboidal contour in case of a billet rather than a square shaped (desired) cross section. In the case of round cross section usually there is no deviation of shape or contour of the casting but in certain cases cracks and fissures were observed in the material. In the case of round casting the tubular mold itself exhibited cracks after certain period of time. Seemingly these two phenomena are unrelated; nevertheless it is an aspect of the present invention, that the underlying discovery remedies both problems.

DESCRIPTION OF THE INVENTION

It is a feature of the present invention to improve cooling of and in the mold for continuous casting such that observed deviations in shape and mold damages can be avoided.

It is an object of the present invention to provide a new and improved mold for continuous casting of round cross sections or billets particularly for casting of steel using a tubular mold which is surrounded by a tubular coolant guide structure establishing a gap immediately adjacent the mold.

In accordance with the preferred embodiment of the present invention it is suggested that at least in the upper portion of the mold tube the tubular envelope around the mold is provided wtih cooling grooves extending predominantly in longitudinal direction and being arranged on the side facing away from the liquid content of the mold. This feature reduces the temperature on the water side of the mold. The heat to be removed will be removed fairly uniformly from the periphery so that thermal tension in the casting and in the mold itself i.e. local excess heating of the mold is avoided. This feature avoids particularly the formation of a romboidal cross section for a billet and also damage to a round mold itself can be avoided.

It should be noted that in the case of billet casting German printed patent application No. 1,092,613 suggests to provide very narrow slots being open towards the outside and running in longitudinal as well as in peripheral direction. These slots are provided particularly in the mold wall plates. These slots however were realized only in plates for the casting of slab ingots because these walls are about 40 mm thick and thicker. Nevertheless these plates offer the problem that with a declining plate thickness and increasing depth of the respective slots the mechanical strength of these plates is reduced significantly. Thus the reducing depth of the slot and increasing thickness of the wall plate increases the propensity of the plates towards excessive temperatures.

The basic concept of the invention can preferably be realized by providing these cooling grooves only within the level of the casting bath surface level inside the mold. The grooves should extend axially in the mold wall. However, as variance it is suggested to have the cooling slots arranged in a helical pattern on the tubular mold. This feature enhances the safety and certainty of cooling even if the cooling such as regular water is not completely satisfactory e.g. as to the normally observed requisite degree of purity.

In furtherance of the invention it is suggested to provide these cooling grooves with a cross section having trapezoidal shape. This kind of contour increases the effective area of cooling and the intensity of cooling is increased accordingly. Following this particular feature any disadvantageous effects of having cooling grooves in relatively thin mold walls are avoided by causing the bottom of the cooling grooves to be round. The disadvantages effect counteracted here is a kind of notch effect. Also within the purview of increasing load bearing capabilities of the mold it is suggested to provide the wall thickness of the wall and the depth of the cooling groove within the range of 2.4–1.0 or larger.

Excess heating and therefore texture and grain structure changes in the mold are avoided particularly by observing certain geometric relations. The center-to-center distance between adjacent grooves establishes an effective cooling surface which, through the mold wall is radially aligned with a incremental inside surface of the mold cavity. The effective cooling surface now is to be from 1.4–2.0 times larger than the said inside surface of the tubular mold being exposed to the liquidous metal and facing the total cooling area in radial alignment.

The cooling conditions for both the casting and the mold can be further improved by providing a coolant flow speed within the grooves in the range of 10 to 12 m/sec. The flow speed of the coolant can be increased without changing the quantity of cooling medium by providing that the distance in between the tubular mold and the tubular cooling guide sheet, in the range of the cooling grooves i.e. adjacent to the grooves is reduced particularly as compared with the gap between the guide sheet and that portion of the mold which is not provided with grooves. The resulting speed increases can actually be fully transfered upon the cooling grooves in that the distance between the mold wall and the outer cooling and flow guide sheet is in effect zero in the range of the grooves, i.e. the tubular guide sits directly on the ridges between the grooves.

In order to maintain the thermal load on the tubular mold within bearable limits it is of advantage to increase the wall thickness of the flow guide sheet in the range of the grooves.

In direct opposite to prior art practice it is moreover suggested to provide a cooling flow through the cooling grooves and the angular gap in the direction which runs from top to bottom. The high pressure of the coolant such as water adjacent the hottest zone of the mold will increase the boiling temperature so that in the area of the casting level the formation of bubbles is avoided. This feature in turn avoids uneven cooling. Moreover any pressure loss and therefore speed loss is limited to the lower path of the mold.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings FIG. 1 illustrates a mold 1 for casting particular ingots. The figure can be construed to be a cross section through a mold with square shaped configuration for the casting of billets but alternatively the fig. can be construed to have a round cylindrical mold interior for casting of rounds. The tubular mold 2 is enveloped in a water jacket 3 connected to a coolant feed inlet tube 4 and colant discharge tube 5. The box or jacket 3 contains a coolant guide sheet 7 of tubular configuration. This tubular guide sheet 7 is spaced radially from the mold 2 establishing an annular cooling gap and flow space 6. The tubular mold 2 is contained within the machine for continuous casting 1 by means of flanges 8 and 9. The mold 2 is mounted to these flanges 8 and 9 which in turn mount the mold to the stand at large.

Figure 1:
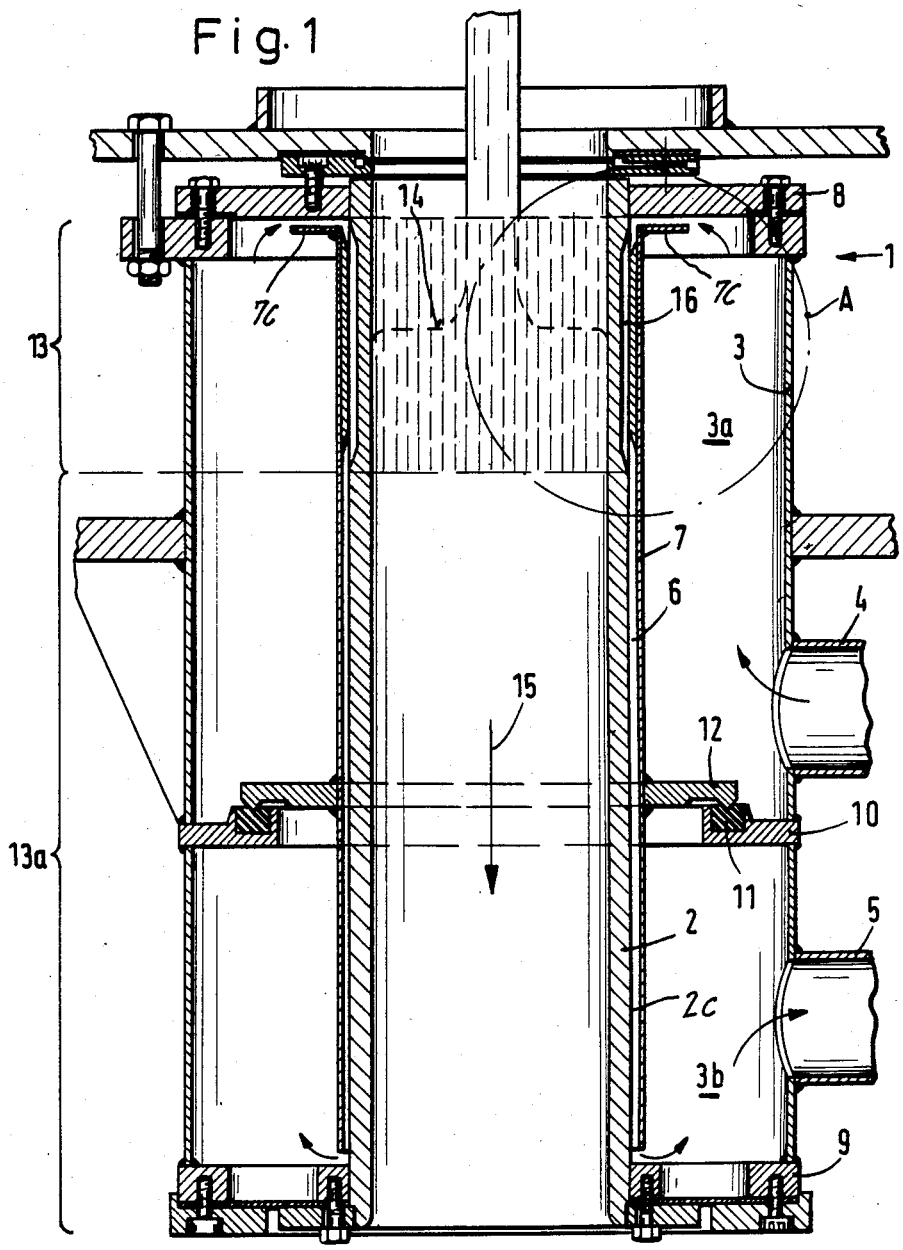
FIG. 1 is a longitudinal section view through a mold for continuous casting either of rounds or of billets with square-shaped cross section and including improvements in accordance with the preferred embodiment of the present invention for practicing the best mode thereof.

The coolant container box or jacket 3 is basically partitioned into an inlet chamber 3*a* and a return chamber 3*b*. These chambers are separated by means of a flange plate of annular configuration 10 having a sealing 11 for cooperation with a sealing plate 12 which is secured to the tubular guide sheet 7. The flanges 8 and 9 are also connected to the jacket, box or container 3.

It can be seen that coolant (water) flows from the inlet tube 4 into the inlet chamber 3*a*, around an upper flange 7*c* of the guide sheet 7, into the gap 6 and in vertical down direction, all the way through the gap 6 i.e. down alongside the outer surface of the mold and around the bottom edge of tubular guide sheet 7 back into the return flow chamber 3*b* for discharge to the coolant outlet tube 5.

The bracket 13 illustrates the upper portion of the mold and denotes particularly the level ranges for the open surface of the bath of molten material that is maintained therein. The remainder of the interior of the mold is denoted by range 13*a*. The range 13 which is an operational range as far as the interplay of pouring molten metal and the onset of solidification is concerned; range 13*a* denotes the range in which the ingot's skin is sufficiently strengthened to permit withdrawing the casting at the bottom. Cooling grooves 16 are provided in the mold wall in range 13. Then grooves are shown in greater detail in FIGS. 2 and 3; these are coolant grooves cut into the mold wall from the outside, and they have a V-shaped cross section, or one can say that they have basically trapezoidal cross section with rounded bottom. These grooves 16 extend straight i.e. parallel to the longitudinal direction 15 of the mold tube. However the grooves 16 may run helically along the outer surface 2*c* of the mold tube 2.

By way of example the mold tube 2 has a wall thickness 2*a* which is for example 17 mm and the depth 16*a* of the grooves does not exceed 1/2.4 of the wall thicknes 2*a* of the mold. The outer width 16*b* of the cooling grooves taken in conjunction with the depth and the contour of the slots establishes the surface that is in fact being cooled. Reference numeral 20 denotes the center to center distance between adjacent cooling grooves 16. Reference numeral 21 refers to the mold surface on the inside within that range, from center to center, as far as the cooling groove is concerned which is wetted by liquid metal in the mold.

Reference numeral 16*c* denotes the radially aligned surface as far as a coolant duct system is concerned being in contact with coolant flow. It can readily be seen that this surface portion 16*c* of the cooling channels is considerably larger than the area 20 which within the given definition is inside adjacent the particular coolant area. The entire mold around the axis can be so divided into incremental portions such as 20 which are in contact with the liquidous metal, and into incremental portions such as 16*c* being in intimate contact with the coolant flow. It can be seen that the area 16*c* is larger than the area 20 and the stated rule above is that the coolant area 16*c* should be from 1.4 to 2.0 times the area 20.

Figure 3:
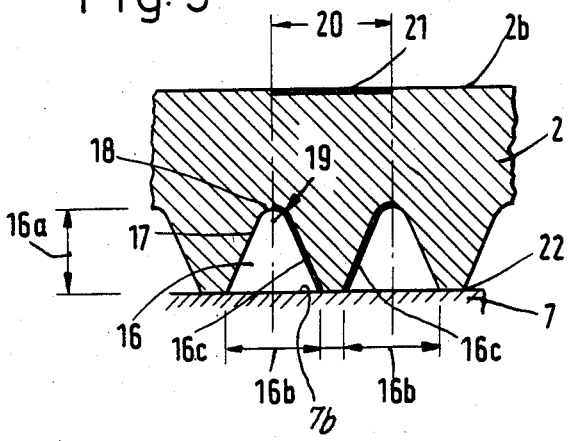
FIG. 3 shows a cross section through the cooling slots for example in a plane indicated by 3—3 in FIG. 2.

The spacing 22 between mold tube and the tubular coolant guide sheet is different in the two areas 13, 13*a* i.e. it is smaller in the area 13 than in the area 13*a*. Generally speaking the area 13*a* is not provided with any grooves such as 16. In fact the tube 7 is provided with a reinforcement that extends radially inwardly from the tubular sheet 7 itself and in the zone or area 13 such that the cylindrical inner surface 7*b* of that reinforcement coincides with the outer diameter of the tubular mold 2. In fact as shown in FIG. 3 this reinforcement surface 7*b* abuts the outer edges of the ridges between the cooling grooves or channels 16. This feature forces all of the coolant into the channels and grooves 16.

Figure 2:
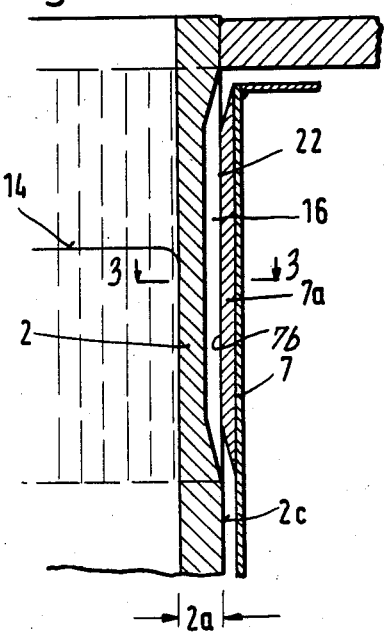
FIG. 2 illustrates a detail as indicated by the circle A in FIG. 1, the detail is shown in larger scale.

It can thus be seen that in accordance with the invention a coolant flow is enforced upon the coolant medium, such as water, in that from the inlet chamber 3*a* the water flows around the flange 7*c* and as can be seen best from FIG. 2 directly into the channels or grooves 16. Below the zone 13 and the coolant continues normally in the gap 6 between tubular sheets 7 mold wall 2.

The invention is not limited to the embodiments described above but all changes and modifications thereof, not constituting departures from the spirit and scope of the invention, are intended to be included.

We claim:

1. In a mold for continuous casting of rounds or billets including a tubular mold enveloped by a coolant container or jacket, there being a tubular coolant guide sheet provided around the tubular mold, coolant flowing through an anular gap between the mold and the guide sheet, the improvement comprising:

longitudinal coolant ducts provided as grooves in the upper portion of the mold only, the upper portion of the mold covering less than the remaining portion of the mold taken in axial direction of casting, the ducts being on the outside of the mold for relatively increasing the surface area of the mold tube exposed to coolant over and beyond the surface area of the outside of the tubular mold of the remaining portion thereof, and over and beyond the cylindrical surface area defined by ridges between the grooves.

2. The improvement as in claim 1 wherein said cooling ducts have essentially trapezoidal cross section.

3. The improvement as in claim 2 wherein said cooling ducts have a bottom which is rounded.

4. The improvement as in claim 1 wherein the mold wall has a thickness which is at least 2.4 times the depth of the grooves.

5. The improvement as in claim 1 including means in said guide sheet reducing the gap between outer mold wall surface and tubular guide sheet adjacent to said ducts.

6. The improvement as in claim 1 including means projecting radially inwardly from said guide sheet and into a hypothetical cylindrical surface as established by the outer mold wall surface.

7. The improvement as in claim 1 wherein the surface area of each groove as exposed to coolant flow is from 1.4 to 2.0 times the respective radially aligned incremental surface area on the inside of said mold as exposed to liquid metal during casting.

* * * * *